United States Patent [19]

Steinberger

[11] Patent Number: 4,690,028

[45] Date of Patent: Sep. 1, 1987

[54] STRING CLAMPING DEVICE

[75] Inventor: Ned Steinberger, Cornwall, N.Y.

[73] Assignee: Steinberger Sound Corporation, Newburgh, N.Y.

[21] Appl. No.: 853,670

[22] Filed: Apr. 18, 1986

[51] Int. Cl.[4] ..... G10D 3/12

[52] U.S. Cl. ..... 84/314 N; 84/297 R; 84/313

[58] Field of Search ..... 84/297 R, 312, 313, 84/314 R, 314 N

[56] References Cited

U.S. PATENT DOCUMENTS

| | | | |
|---|---|---|---|
| 475,674 | 5/1892 | Cook | 84/297 R |
| 2,844,985 | 7/1958 | Ferriera | 84/312 R |
| 3,606,301 | 6/1969 | Ultimo | 269/243 |
| 4,171,661 | 10/1979 | Rose | 84/314 N |
| 4,248,127 | 2/1981 | Lieber | 84/314 N |
| 4,475,432 | 10/1984 | Stroh | 84/314 N |
| 4,517,874 | 5/1985 | Fender | 84/314 N |
| 4,572,049 | 2/1986 | Tanaka et al. | 84/313 |
| 4,574,678 | 3/1986 | Edwards | 84/314 N |
| 4,579,033 | 4/1986 | Edwards | 84/314 N |
| 4,608,906 | 9/1986 | Takabayashi | 84/313 |
| 4,638,711 | 1/1987 | Stroh | 84/313 |

*Primary Examiner*—Lawrence R. Franklin
*Attorney, Agent, or Firm*—Finnegan, Henderson, Farabow, Garrett & Dunner

[57] ABSTRACT

A clamping device for the strings of a musical instrument includes a base with stationary clamping plates and a threaded shank, movable clamping plates in opposed relation to the stationary clamping plates, nuts threaded on the shank, actuators interposed between a threaded nut and a movable clamping plate for selectively applying clamping pressure to a movable clamping plate by engaging and rotating with a threaded nut while rotating relative to a movable clamping plate for clamping a string between the movable clamping plate and the stationary clamping plate.

15 Claims, 9 Drawing Figures

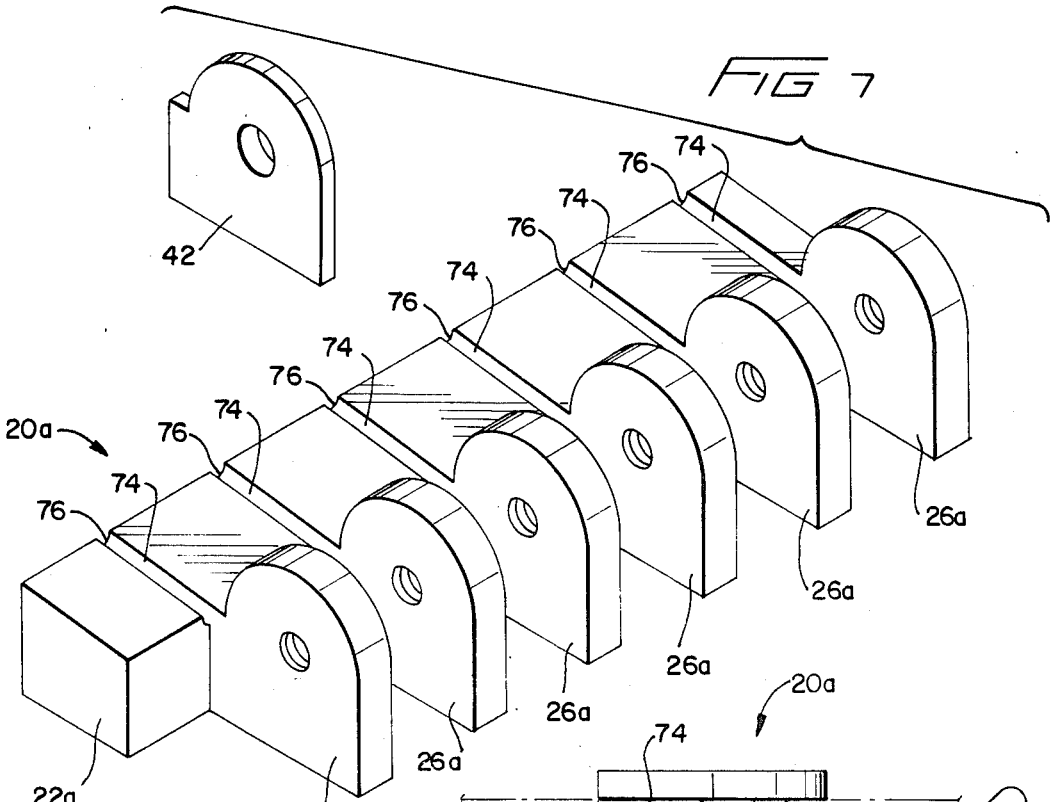
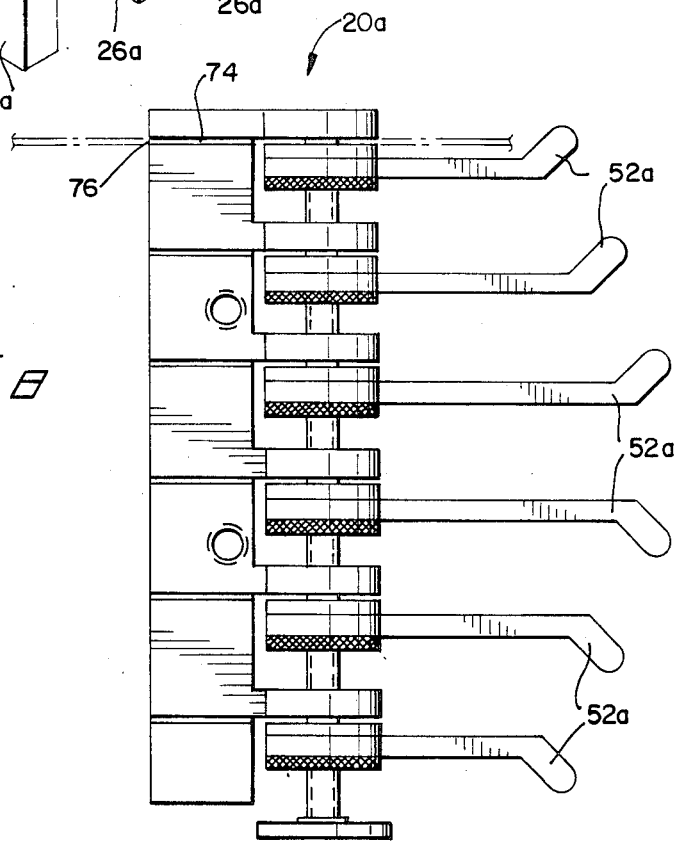
FIG 8
FIG 9
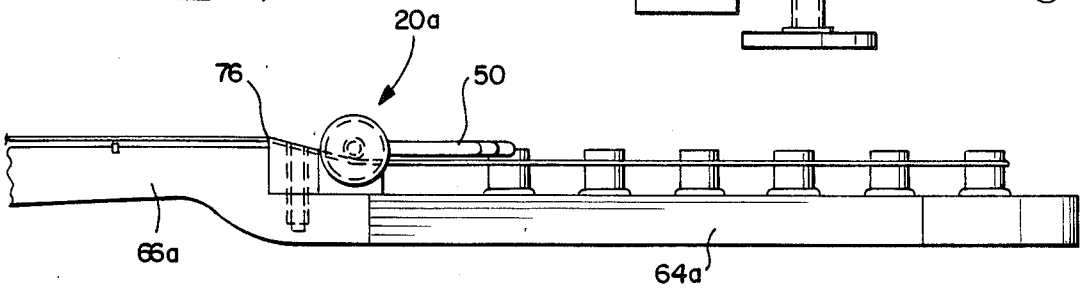

STRING CLAMPING DEVICE

BACKGROUND OF THE INVENTION

I. Field of the Invention

The invention relates to clamping devices, and more particularly, to clamping devices for fixing the strings of a musical instrument.

II. Description of the Related Art

Clamping devices have been used to clamp the strings of a musical instrument in order to anchor the ends of the strings and to prevent sliding movement of the strings over the nut and the bridge of the instrument when a tremolo mechanism is used.

Known string clamping devices have a variety of shortcomings. Some are complex mechanisms which are expensive to manufacture. Others are difficult to use or require tools to be used. Still others do not permit adequate individual adjustment, control, and accommodation of each string.

Accordingly, it is an object of this invention to provide a clamping device which is a simple mechanism and inexpensive to manufacture.

It is another object of this invention to provide a clamping device which is easy to use and which can be operated without tools.

It is a further object of this invention to clamp each string of a stringed instrument individually to allow individual adjustment, control and accommodation of each string.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a clamping device comprising a base, the base including a threaded shank and a stationary clamping plate; a threaded nut threaded on the threaded shank; and actuation means interposed between the threaded nut and the stationary clamping plate for selectively applying clamping pressure to a workpiece positioned between the actuation means and the stationary clamping plate by engaging and rotating with the threaded nut as clamping pressure is applied to the workpiece.

It is preferable that a movable clamping plate be positioned in opposed relation to the stationary clamping plate such that it is freely slidable relative to the threaded shank and so that the actuation means is interposed between the threaded nut and the movable clamping plate for selectively applying clamping pressure to the movable clamping plate by engaging and rotating with the threaded nut while rotating relative to the movable clamping plate for clamping a workpiece between the movable clamping plate and the stationary clamping plate.

It is further preferable that the actuation means include an aperture and a lever portion, and the threaded nut include a radial surface complementary to the aperture for supporting the actuation means.

The accompanying drawings, which are incorporated in and constitute a part of the specification, illustrate preferred embodiments of the invention and, together with a general description given above and the detailed description of the preferred embodiments given below, serve to explain the principles of the invention.

BRIEF DESCRIPTION OF THE DRAWINGS

FIG. 7 is a perspective view of a second embodiment incorporating the teachings of the present invention;

FIG. 8 is a top view of the embodiment shown in FIG. 7; and

FIG. 9 is an end view of the embodiment shown in FIG. 7.

DESCRIPTION OF THE PREFERRED EMBODIMENTS

Reference will now be made in detail to the present preferred embodiments of the invention as illustrated in the accompanying drawings.

In accordance with the present invention, there is provided a clamping device for the strings of a musical instrument comprising a base, the base including a plurality of threaded shank elements and a plurality of spaced stationary clamping plates; a plurality of movable clamping plates each in opposed relation to a respective stationary clamping plate, each movable clamping plate freely slidable relative to the threaded shank elements; a plurality of threaded nuts, each threaded on a respective shank element; a plurality of actuation means, each interposed between a respective threaded nut and movable clamping plate for selectively applying clamping pressure to a respective movable clamping plate by engaging and rotating with a respective threaded nut while rotating relative to a respective movable clamping plate for clamping a string between each of a respective movable clamping plate and a respective stationary clamping plate.

Figure 1:
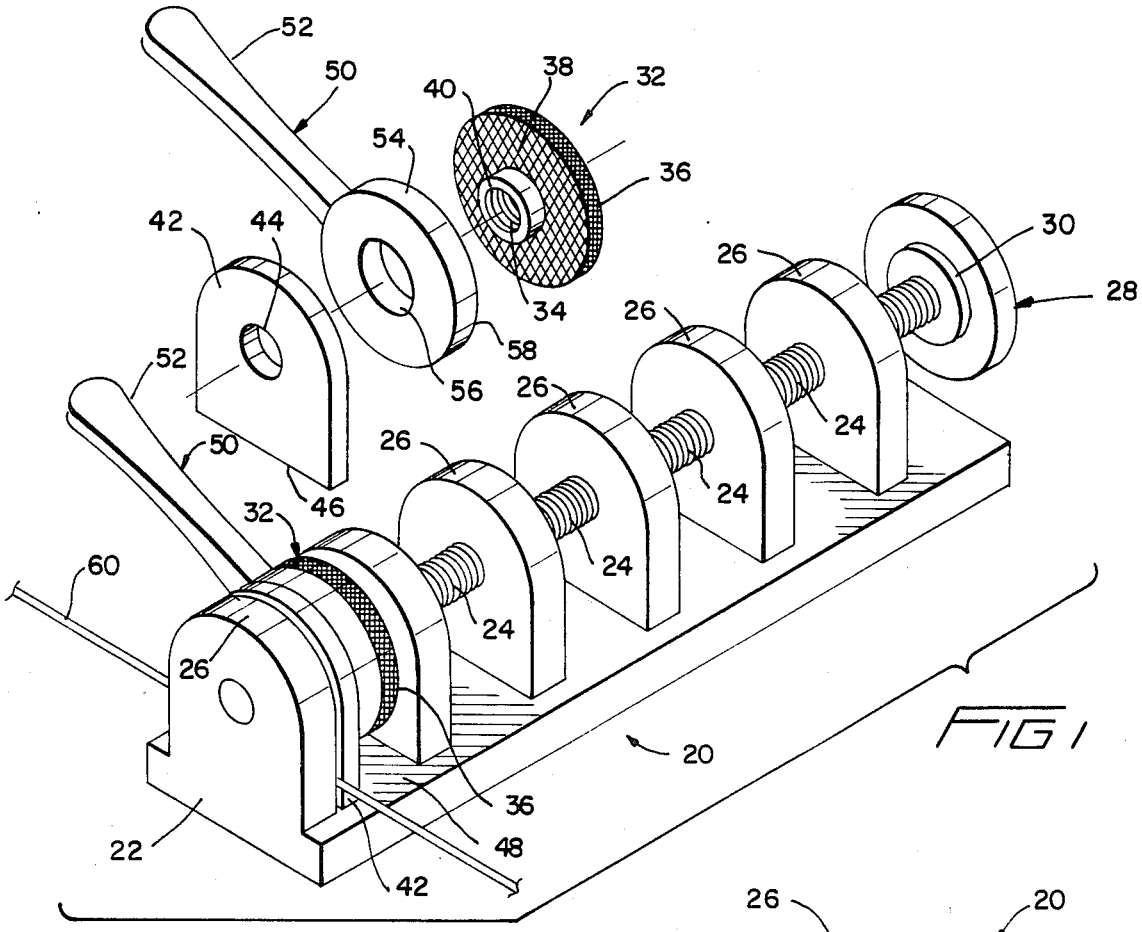
FIG. 1 is a partially exploded perspective view of a first embodiment incorporating the teachings of the present invention.

FIG. 1 shows a clamping device 20 having a base 11 including a plurality of threaded shank elements 24 and a plurality of spaced stationary clamping plates 26. Base 22 may be formed by cutting a series of slots from a block of metal, tapping threaded holes in the remaining stationary clamping plates 26 and inserting a threaded shank 28. Threaded shank elements 24 are constituted by portions of threaded shank 28 which are positioned between stationary clamping plates 26. Threaded shank 28 also preferably includes an enlarged head portion 30.

A plurality of threaded nuts 32 are each threaded on a respective shank element 24. Threaded nuts 32 include a threaded tapped portion 34 which is complementary to the threaded shank elements 24. The outer radial surface 36 of the threaded nut 32 is preferably knurled to allow it to be easily engaged and rotated by an operator's finger. A face means such as axial face 38 on the threaded nuts 32 is preferably a rough surface. A radial surface 40 forms a step portion in threaded nuts 32.

A plurality of movable clamping plates 42 are assembled in opposed relation to the respective stationary clamping plates 26. Each movable clamping plate 42 is freely slidable relative to the threaded shank element 24. Movable clamping plates 42 include an aperture 44 which is larger than the outside diameter of the threaded shank elements 24. Movable clamping plates 42 include means for preventing their rotation relative to base 22 such as flat surface 46 which is complementary to flat surface 48 on base 22.

Clamping device 20 also includes a plurality of actuation means such as actuators 50 which include a lever portion 52 and an annular portion 54 having an aperture 56. Aperture 56 in actuators 50 is supported by complementary radial surface 40 in threaded nut 32. Actuators 50 preferably include face means such as an axial surface 58 that is complementary with axial surface 38 in threaded nut 32. Axial surface 58 is preferably a rough surface so that axial surfaces 58 and 38 frictionally engage and rotate with each other when placed in contact with each other.

Figure 2:
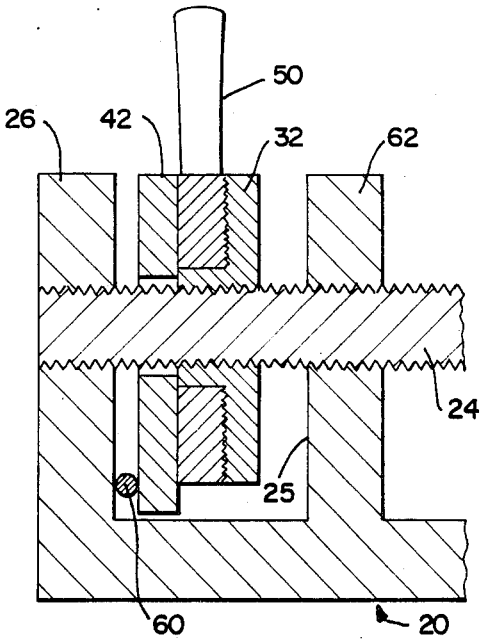
FIG. 2 is a side view of the embodiment shown in FIG. 1.
Figure 3:
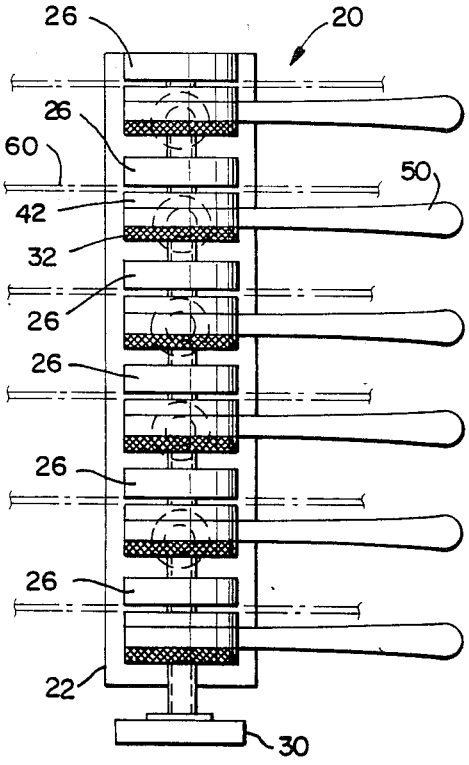
FIG. 3 is a top view of the embodiment shown in FIG. 1.
Figure 4:
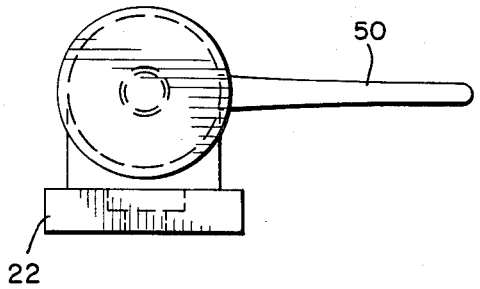
FIG. 4 is an end view of the embodiment shown in FIG. 1.

The operation of the clamping device is best understood from FIG. 2. String 60 is placed between stationary clamping plate 26 and movable clamping plate 42. Threaded nut 32 is rotated with a tip of a finger through the use of knurled surface 36 until it comes in contact with actuator 50 and snugly causes engagement between rough surface 38 on threaded nut 32 and rough surface 58 on actuator 50. This arrangement allows the clamping device to be adjusted to accommodate strings of various thickness.

Lever portion 52 of actuator 50 is then rotated, causing threaded nut 32 to rotate with it due to frictional engagement between rough surfaces 38 and 58. In turn, this causes threaded nut 32 to advance along threaded shank 24 and press movable clamping plate 42 against string 60, clamping it against stationary clamping plate 26.

Actuator 50 rotates relative to movable clamping plate 42 during the clamping operation, thereby preventing undesirable forces from being imparted to string 60. This prevents string 60 from being displaced from its selected position during movement of actuator 50.

Although the use of movable clamping plate 42 is preferred for this reason, it is also within the scope of the present invention to employ an embodiment without a movable clamping plate and thereby clamp the string 60 between stationary clamping plate 26 and actuator 50.

It is preferred that threaded shank 28 extend between stationary clamping plate 26 and a stop such as the reverse side 25 of a stationary clamping plate 26 or the head 30 of threaded shank 28. This arrangement prevents threaded nut 32, actuator 50 and pressure plate 42 from being separated from the remainder of the clamping device assembly. In such a fashion, threaded nut 32, actuator 50 and movable clamping plate 42 are interposed between the stop 62 and stationary clamping plate 26.

Figure 5:
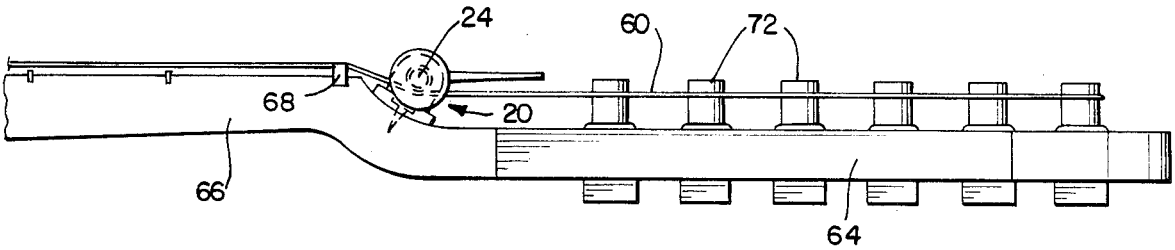
FIG. 5 is an end view of the embodiment shown in FIG. 1 mounted on the head stock of a stringed instrument.

FIG. 5 shows clamping device 20 attached to the head stock 64 of a guitar which extends from the neck 66 of the guitar. The device 20 preferably mounted adjacent the string nut 68 of the guitar, which is the ridge over which the strings pass at the top of the neck of the guitar. Strings 60 rise against the underside of threaded shank 24 to properly hold strings 60 down on string nut 68.

Figure 6:
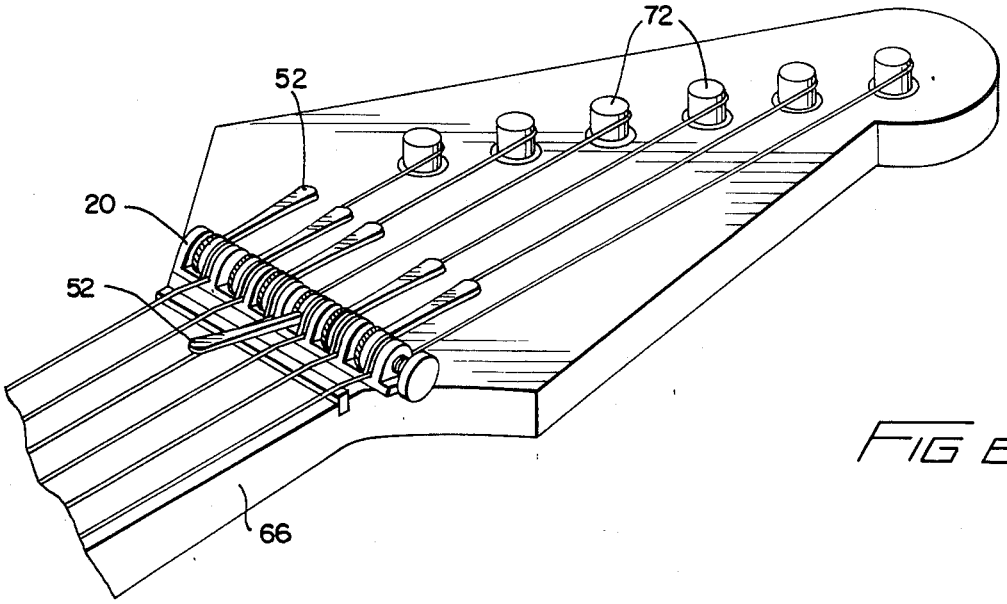
FIG. 6 is a perspective view of the arrangement shown in FIG. 5.

FIG. 6 shows the clamping operation of string clamp 20 wherein one actuator lever is in an open position pointing down neck 66 of the guitar, and the remaining actuator levers 52 are in a closed position pointing away from neck 66 and toward head stock 64. Therefore, as shown in FIG. 6 the clamping motion of actuator levers 52 occurs in a clockwise direction and the unclamping motion occurs in a counterclockwise direction.

The system is preferably constructed so that actuator levers 52 can be rotated as little as 90° to effect good clamping pressure, while the knurled threaded nut 32 can be rotated through 360° to accommodate any variation of string diameter. The actuator lever 52 is long enough to provide the mechanical advantage for sufficient clamping pressure and is only required for the final quarter rotation.

When the string clamp 20 is mounted on the head stock of a guitar, actuator 50 is placed in an open position. Then the string is tuned to the proper pitch by using conventional tuning pegs 72 on head stock 64 of the guitar. Finally, the string is locked into place on the string clamp 20 by actuator lever 52.

A second embodiment of the clamping device, also for use on the head stock of a guitar, is shown in FIG. 7 through 9 and is denoted by numeral **20*a*. Base 22*a* and stationary clamping plates 26*a* are formed so that string slots 74 extend from stationary clamping plates 26*a* to form a string nut 76, which is integral with base 22*a*. Clamping device 20*a* with integral string nut 76 can be mounted on head stock 64*a* of the guitar as shown in FIG. 9**.

A string clamping device according to the present invention may be mounted on the moving part of a tremolo device on a guitar. In addition, it may be mounted on stringed instruments other than guitars, such as violins and banjos.

Additional advantages and modifications will readily occur to those skilled in the art. The invention in it broader aspects is, therefore, not limited to the specific details, representative apparatus and illustrative examples shown and described. Accordingly, departures may be made from such details without departing from the spirit or scope of the applicant's invention.

What is claimed is:

1. A clamping device for clamping the strings of a stringed musical instrument comprising:

a base, the base including a plurality of threaded shank elements, and a plurality of spaced stationary clamping plates forming an array extending across and spaced between the strings of the musical instrument when positioned on the musical instrument;

a plurality of threaded nuts, each threaded on a respective shank element; and a plurality of actuation means, each interposed between a respective threaded nut and stationary clamping plate for selectively applying clamping pressure to a string positioned between a respective actuation means and stationary clamping plate by engaging and rotating with a respective threaded nut as clamping pressure is applied to the string.

2. The clamping device of claim 1 wherein each threaded nut includes means for supporting the respective one of the plurality of actuation means.

3. The clamping device of claim 1 wherein each actuation means is freely rotatable and axially slidable on the respective shank element.

4. The clamping device of claim 1 wherein each threaded nut and respective actuation means include respective face means for selective frictional engagement with each other.

5. The clamping device of claim 4 wherein at least one of the face means is a rough surface.

6. The clamping device of claim 4 wherein each face means includes a generally axial surface.

7. The clamping device of claim 1 wherein the outer radial surface of each threaded nut is knurled.

8. The clamping device of claim 1 wherein each actuation means includes a lever portion.

9. The clamping device of claim 1 wherein the plurality of threaded shank elements constitute portions of a single threaded shank extending through each of the stationary clamping plates.

10. The clamping device of claim 1 wherein the base includes an integral string nut for the musical instrument.

11. A clamping device for clamping the strings of a stringed musical instrument comprising:

a base, the base including a plurality of threaded shank elements, and a plurality of spaced stationary clamping plates forming an array extending across and spaced between the strings of the musical instrument when positioned on the musical instrument;

a plurality of threaded nuts, each threaded on a respective shank element;

a plurality of movable clamping plates each in opposed relation to a respective stationary clamping plate, each movable clamping plate freely slidable relative to the threaded shank elements; and a plurality of actuation means, each interposed between a respective threaded nut and movable clamping plate for selectively applying clamping pressure to a respective movable clamping plate by engaging and rotating with a respective threaded nut while rotating relative to a respective movable clamping plate for clamping a string between each of a respective movable clamping plate and a respective stationary clamping plate.

12. The clamping device of claim 11 wherein each movable clamping plate includes means for preventing rotation of the movable clamping plate relative to the base.

13. The clamping device of claim 11 also including a plurality of stops, and wherein each threaded shank element extends between a respective one of the plurality of stops and a respective one of the plurality of stationary clamping plates, and wherein each respective threaded nut, actuation means and movable clamping plate are interposed between a respective one of the plurality of stops and a respective one of the plurality of stationary clamping plates.

14. The clamping device of claim 13 wherein each actuation means includes an aperture, and each threaded nut includes a radial surface complementary to the respective aperture for supporting the respective actuation means.

15. The clamping device of clain 13 wherein each actuation means includes an aperture and each threaded nut includes a step complementary to the respective aperture for supporting the respective actuation means.

* * * * *